US007180303B1

(12) United States Patent
Chen et al.

(10) Patent No.: US 7,180,303 B1
(45) Date of Patent: Feb. 20, 2007

(54) SIMPLE PARTIAL DISCHARGE DETECTOR FOR POWER EQUIPMENT USING ACOUSTIC EMISSION TECHNIQUE

(75) Inventors: Jiann-Fuh Chen, No. 1, Tahsueh Rd., Tainan City (TW); Chen-Chi Tai, Tainan (TW); Tsorng-Juu Liang, Tainan (TW); Ching-Chau Su, Tainan (TW); Ching-Shun Yi, Tainan (TW); Chien-Yi Chen, Tainan (TW)

(73) Assignees: Unelectra International Corp., Taipei (TW); Precision International Corp., Taipei (TW); Jiann-Fuh Chen, Tainan (TW); Cheng-Chi Tai, Tainan (TW)

( * ) Notice: Subject to any disclaimer, the term of this patent is extended or adjusted under 35 U.S.C. 154(b) by 0 days.

(21) Appl. No.: 11/290,579

(22) Filed: Dec. 1, 2005

(51) Int. Cl.
*H01H 9/50* (2006.01)

(52) U.S. Cl. ..... 324/536

(58) Field of Classification Search ..... 324/536
See application file for complete search history.

(56) References Cited

U.S. PATENT DOCUMENTS 5,214,595 A * 5/1993 Ozawa et al. ..... 702/58
2003/0214307 A1* 11/2003 Kang et al. ..... 324/536

* cited by examiner

*Primary Examiner*—Andrew H. Hirshfeld
*Assistant Examiner*—Timothy J. Dole
(74) *Attorney, Agent, or Firm*—Rosenberg, Klein & Lee

(57) ABSTRACT

The present invention relates to a simple detector for partial discharge with the acoustic emission technique, which provides essentially with an acoustic emission sensor being set on a power equipment. Still, the output of the acoustic emission sensor is connected with a preamplifier and a bandpass filter in turn and the output of the bandpass fitted up with a comparator. The signals of square waves generated by the comparator can be transmitted to a microprocessor as concurrently as a counter in the microprocessor can be used to count up times for partial discharge by seconds; then, the resulted times can be displayed. Consequently, it is convenient to determine whether the power equipment is necessarily maintained by means of counting up times for partial discharge.

2 Claims, 3 Drawing Sheets

SIMPLE PARTIAL DISCHARGE DETECTOR FOR POWER EQUIPMENT USING ACOUSTIC EMISSION TECHNIQUE

BACKGROUND OF THE INVENTION

1. Field of the Invention

The present invention relates to a simple discharge detector for a power equipment using the acoustic emission technique, in which acoustic emission signals are particularly transformed into square-wave signals by a comparator and then transmitted to a microprocessor, and a counter inside the microprocessor is provided to count times of partial discharge so as to determine whether the power equipment needs to be maintained or not.

2. Related Prior Arts

To promote efficiency of electricity transmission, voltage during transmission is greatly increased, and thus insulated material used for transformers and gas insulated switchgears (GIS) in plants are necessarily capable of standing high potential. When the insulated material worsens, the transformers may be damaged or even explode, which will result in power failure and disrupture of plants. Therefore, it's more and more important to maintain and detect power equipment.

So far, the technologies applied to detecting partial discharge of power equipment can be mainly classified into two kinds, namely electric method and non-electric method.

1. Electric Detection for Partial Discharge

In this method, pulse current of partial discharge in the detection circuit can be detected, which is easily quantified and highly sensitive. The detection circuit comprises either a couple capacitor or a Rogowski coil.

(1) Couple Capacitor

The couple capacitor with properties of divided potential and filtering is connected to the high-voltage side of the power equipment; and the pulse current signals of partial discharge are detected according to the principle of divided potential and filtering. As frequencies of the signals are generally more than 5 MHz, cost for computer treatment at post-end of the couple capacitor is quite high. Therefore, this method is normally applied to quality assurance of equipment before releasing from plants other than on-line detection.

(2) Rogowski Coil

Rogowski coil is generally applied to on-line detection. When partial discharge occurs, pulse current of partial discharge will flow through ground line of the power equipment, and the Rogowski coil may sense the pulse current from the ground line. However, frequencies of such current signals are as high as several MHz~tens of MHz, and thus cost for computer treatment at the post-end is even higher. For common industries, grounding is a complicated issue as the partial discharge signals are easily interfered and covered by other signals. To solve such problems, a better filter or a more complicated filtering program is required and thus cost will be much higher.

2. Non-electric detection for partial discharge

The non-electric detection for partial discharge comprises acoustic detection and optical detection.

(1) Acoustic Detection (a) Ultrasonic Microphone

When the source of partial discharge exists in the air, a phenomenon similar to corona occurs and ultrasonic waves generated from partial discharge will be transmitted via air. Therefore, the discharge source can be easily detected with an ultrasonic microphone. However, when the source of partial discharge is caused by media inside the equipment, for example, insulated oil in an oil-immersed transformer, resin in the cast resin transformer and $SF_6$ in GIS; the acoustic waves of discharge are hardly transmitted to the air via theses media isolated from the air. Therefore, an acoustic emission sensor is required for detecting inside discharge.

(b) Acoustic Emission Sensor

The partial discharge occurring inside equipment is similar to pulses and will generate mechanical pressure waves inside the media. This phenomenon can be analogized to acoustic emission (AE), which is possibly caused by impact between molecules of interior material and adjacent structures. Such acoustic source will widely emit acoustic waves in the equipment, as shown in FIG. 1. Whether the acoustic waves will emit from the equipment to the air is determined by the acoustic impedance of these two media. In general, difference between them is too large to cause emission from equipment to the air. That is, it's unfeasible to detect an interior source with the ultrasonic microphone.

In the acoustic emission method, an AE sensor (81) firmly attached to the surface of equipment (82) is utilized, and mechanical pressure waves are converted into electrically signals by a piezoelectric material inside the AE sensor (81), as shown in FIG. 1. The AE signals are further amplified through a preamplifier (83). In this method, frequencies of the acoustic wave signals generally range from 20 kHz to 80 kHz, which are much lower than those obtained in the above methods and thus costs much less.

(2) Visual or Optical Detection

When corona discharge occurs in the power equipment, temperature on surfaces of the equipment will increase and thus the source can be detected with an infrared thermal radiometer. Alternatively, spectrum of light generated due to gas ionization in the discharge corona can be inspected with a UV discharge detector. However, facilities used for these two methods are expensive, and merely surface corona can be detected. As for discharge occurring inside or shielded, these facilities are ineffective.

(3) Analysis of Gas Dissolving in Oil

For the power equipment using insulated oil, partial discharge can be detected in certain situations by analyzing species and contents of gas generated during discharge and dissolved in the oil. As it usually takes a long time to dissolve the gas in the oil, therefore the oil is analyzed several times or continuously during operation of the equipment. However, analysis of the oil is usually performed with expensive and complicated instruments for a period of time, and results thereof require being precise enough. As application of this method is limited to the power equipment using insulated oil, therefore other methods have to be developed for GIS or cast resin transformers.

FIG. 2 indicates the principal for designing a general detector for partial discharge, in which a host (91) with high-speed CPU and a lot of memories and hard disks are required. Moreover, the analog/digital (A/D) converter (92) is designed multi-channeled, so that the analog signals in channels can be converted into digital data with time sharing. Huge data will be stored in memories with large volume and then analyzed and identify with the CPU. When finish ing work with the CPU, these data are restored in the memories. As a result, it has to take minutes or more time to deal with data in each channel.

For general manufacturers, the desired function is just to find abnormal equipment other than analyze or identify data like a manufacturer or a maintainer of equipment.

In most plants, it's also difficult to detect equipment distributed in a large area. For example, cast resin transformers in a high-technology plant are generally arranged in a power control chamber with length and width more than ten meters. Moreover, GCB (gas circuit break) and GIL (gas insulated transmission line) are generally separated from a distance over hundreds of meters. For such situations, conventional detectors for partial discharge will be improper due to demerits such as signal decay of long cables and fencing of cast resin transformers in the high-technology plants.

In addition, lines for transmitting analogical signals can not be too long due to interference of signals generated by high-voltage equipment, and lines for transmitting digital data require superior anti-interference.

Accordingly, it's desired to develop a detector for partial discharge with better characteristics and lower cost.

SUMMARY OF THE INVENTION

The present invention therefore provides a simple detector for partial discharge to ameliorate demerits of the conventional detectors.

In the present invention, the simple detector for partial discharge with an acoustic emission technique comprises: an acoustic emission sensor set on a power equipment, a preamplifier and a bandpass filter sequentially connected to an output of the acoustic emission sensor, and a comparator connected to an output of the bandpass filter to transmit the square-waves signal generated by the comparator to a microprocessor which comprises a counter. Accordingly, it is convenient to determine whether the power equipment is necessarily maintained by means of counting times for partial discharge by second.

The detector of the present invention needs no host, costs much low, and real-time inspection can be achieved. If central inspection is necessary, the microprocessor may transmit counts of the counter to the host through an asynchronous-serial-transmission interface, and thus load of the CPU in the host can be reduced.

DETAILED DESCRIPTION OF THE PREFERRED EMBODIMENTS

The present invention will be further illustrated with the preferred embodiments and the related drawings.

Figure 1:
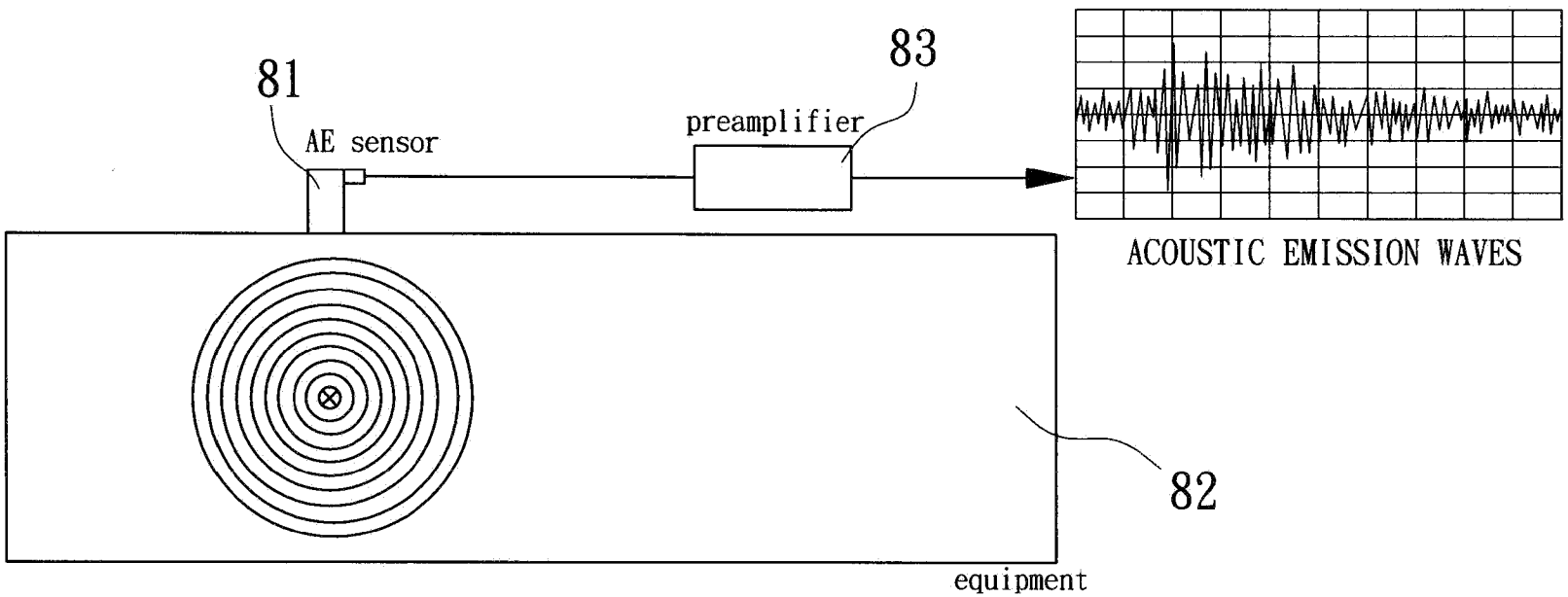
FIG. 1 shows transmission of the acoustic waves.
Figure 2:
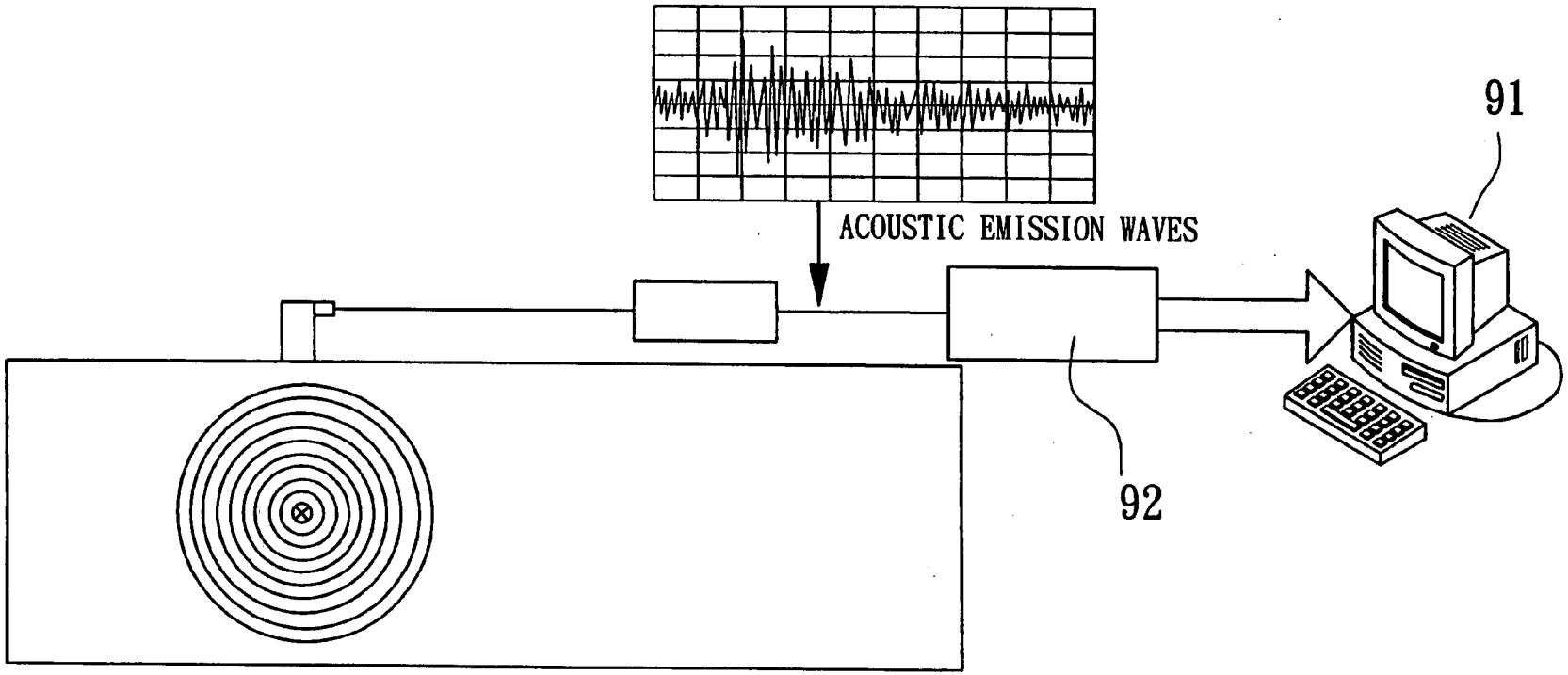
FIG. 2 (PRIOR ART)
FIG. 2 shows the conventional detector for partial discharge.
Figure 3:
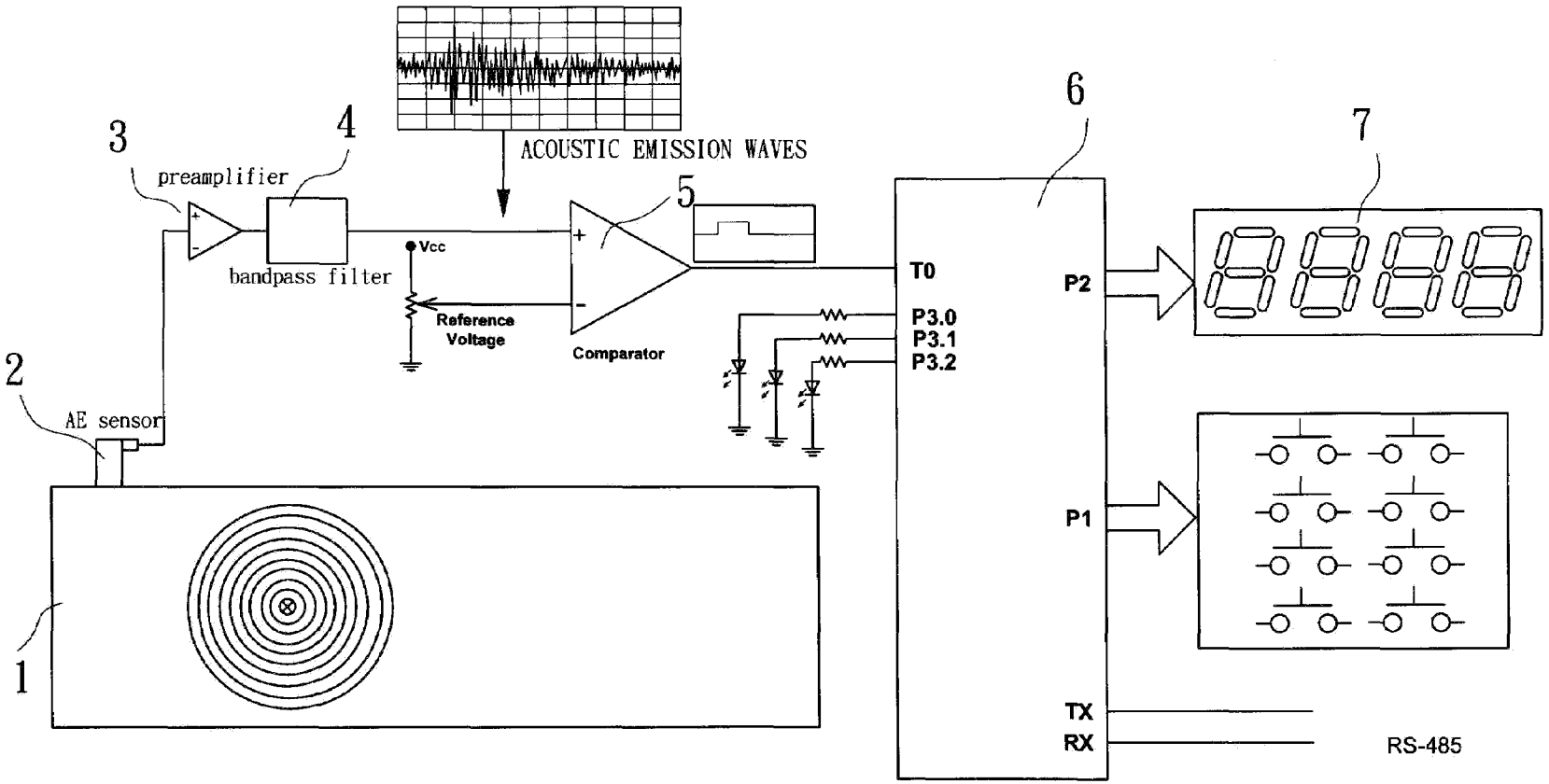
FIG. 3 shows the detector for partial discharge of the present invention.

Please refer to FIG. 3, which shows a simple detector for partial discharge with an acoustic emission technique in accordance with the present invention. On a power equipment (1), an acoustic emission sensor (2) is set to capture acoustic emission signals generated by the power equipment (1). A preamplifier (3) is connected to an output of the acoustic emission sensor (2) to amplify the acoustic emission signal. A bandpass filter (4) is connected to the preamplifier (3) to filter the acoustic emission signals having high and low frequencies. A comparator (5) is set on the output of the bandpass filter (4) to transform the acoustic emission signals having proper frequencies into square-wave signals which are then transmitted to a microprocessor (6). The microprocessor (6) comprises a counter inside to count times for partial discharge by second. An output of the counter is connected to a display (7) on which number of counts is shown. In accordance with the times for partial discharge, maintenance of the power equipment (1) or not is determined.

When partial discharge occurs, the acoustic emission signals sensed by the AE sensor (2) can be amplified with the preamplifier (3) and further filtered off the acoustic emission signals having high and low frequencies with the bandpass filter (4), so that the acoustic emission waves with appropriate shapes can be obtained. Next, the acoustic emission signals are transformed into square-wave signals through the comparator (5) and further transmitted to the microprocessor (6). The microprocessor (6) comprises a counter inside to count times for partial discharge by second, and then output the number of times to the display (7) for displaying.

When no partial discharge occurs, no square-wave signal is generated and the counting number "0" will be shown on the display (7), and also the light of the indicator of the single chip will be green.

In general, "discrete" acoustic emission signals could occur due to background interference or other switch turning on/off, and the light of the indicator of the microprocessor (6) will be yellow accompanied with the counting number shown on the display (7) for warning.

"Periodical" acoustic emission signals could also occur due to partial discharge of the power equipment (1), and the light of the indicator of the microprocessor (6) will be red accompanied with the counting number shown on the display (7). Eventually, maintenance for the power equipment (1) is a must.

Moreover, the microprocessor (6) generally comprises an asynchronous-serial-transmission interface, so that the counting number can be transmitted to the host for central control. Particularly, when applying the RS-485 protocol, one-to-many communication can be achieved via only one signal line, even from a distance of miles. Since only the counting number is transmitted to the host, load of CPU in the host can be neglected.

According to the above embodiment, merits of the present invention compared with the conventional are as follows:

1. Cost is effectively reduced as frequencies of the acoustic-wave signal generated due to partial discharge are only as low as 20~80 kHz, which can be detected with a detector assembled by general electric elements and a lower-cost microprocessor.

2. The detector of the present invention can be independently applied without a host.

3. Real-time inspection can be achieved.

4. For central inspection, only the counting number is transmitted to the host through the asynchronous-serial-transmission interface of the microprocessor, and therefore load of CPU in the host can be neglected.

While the present invention can be illustrated with the above embodiment, scope of the present invention should not be limited thereto. Changes and modifications according to the embodiment may be made without departing from the scope and spirit of the invention as set forth in the following claims.

What is claimed is:

1. A simple discharge detector for a power equipment using an acoustic emission technique, comprising:

an acoustic emission sensor set on power equipment to sense acoustic emission signals generated from said power equipment;

a preamplifier connected to an output of said acoustic emission sensor to amplify said acoustic emission signals;

a bandpass filter connected to said preamplifier to filter off acoustic emission signals having high and low frequencies;

a comparator having a first input connected to an output of said bandpass filter to receive said filtered acoustic emission signals therefrom and a second input coupled to a reference voltage, said comparator having an output providing square-wave signals corresponding to said filtered acoustic emission signals having a magnitude greater than said reference voltage;

a microprocessor having an input coupled to said output of said comparator and an output coupled to a numeric display, said microprocessor including a counter for counting a number of said square-wave signals received per second and said microprocessor outputting said count said numeric display for displaying partial discharge occurrences per second, said microprocessor illuminating an indicator responsive to said microprocessor detecting receipt of periodic acoustic emission signals.

2. The simple discharge detector for a power equipment using an acoustic emission technique as claimed in claim 1, wherein said microprocessor includes an asynchronous-serial-transmission interface and transmits counts of said counter to a host using a communication protocol of RS-485, wherein inspection of the power equipment can be achieved via a signal line.

* * * * *